US011280566B1

(12) United States Patent
Rigler

(10) Patent No.: US 11,280,566 B1
(45) Date of Patent: Mar. 22, 2022

(54) BUFFER BUMPER ASSEMBLY FOR USE WITH A WEAPON RECOIL SPRING

(71) Applicant: R7 Bar, LLC, Rolla, MO (US)

(72) Inventor: Joseph W. Rigler, Rolla, MO (US)

(73) Assignee: R7 Bar, LLC, Rolla, MO (US)

( * ) Notice: Subject to any disclaimer, the term of this patent is extended or adjusted under 35 U.S.C. 154(b) by 0 days.

(21) Appl. No.: 17/149,970

(22) Filed: Jan. 15, 2021

Related U.S. Application Data

(60) Provisional application No. 62/961,969, filed on Jan. 16, 2020.

(51) Int. Cl.
*F41A 3/84* (2006.01)
*F41A 3/78* (2006.01)

(52) U.S. Cl.
CPC .. *F41A 3/84* (2013.01); *F41A 3/78* (2013.01)

(58) Field of Classification Search
CPC ..... F41A 3/78; F41A 3/84; F41A 3/80; F41A 3/82; F41A 3/86; F41A 3/88
See application file for complete search history.

(56) References Cited

U.S. PATENT DOCUMENTS 1,822,079 A * 9/1931 Bull ..... F41A 3/80 89/198
6,829,974 B1 * 12/2004 Gwinn, Jr. ..... F41A 3/70 89/130
7,131,367 B1 * 11/2006 Boerschig ..... F41A 3/94 89/198
7,478,495 B1 * 1/2009 Alzamora ..... F41C 23/04 42/74
9,080,823 B1 * 7/2015 Mantas ..... F41A 3/84
9,341,437 B1 * 5/2016 Huang ..... F41A 3/84
9,395,148 B1 * 7/2016 Huang ..... F41C 23/06
9,879,930 B2 * 1/2018 Cassels ..... F41A 3/84
9,915,492 B2 * 3/2018 Huang ..... F41C 23/08
9,921,013 B1 * 3/2018 Oglesby ..... F41A 3/80
9,970,722 B1 * 5/2018 Babb ..... F41A 3/82
10,100,896 B2 * 10/2018 Spyche, Jr ..... F41A 25/02
10,415,907 B1 * 9/2019 Kincel ..... F41A 3/84
11,054,200 B1 * 7/2021 Cozad ..... F41A 11/02
2005/0246931 A1 * 11/2005 Poff ..... F41C 23/06 42/1.06
2006/0236853 A1 * 10/2006 Boersching ..... F41A 3/70 89/198

(Continued)

*Primary Examiner* — Joshua E Freeman
(74) *Attorney, Agent, or Firm* — Allen, Dyer, Doppelt & Gilchrist, P.A.

(57) ABSTRACT

A buffer bumper assembly for use with some firearms that incorporate a recoil based operating system. The buffer bumper assembly may be disposed on a buffer bumper structure that may be installed inside of a recoil spring around an end thereof. The buffer bumper assembly comprises an upper segment, a lower segment, a biasing structure and a connector. The upper segment and lower segment are interconnected with the connector and reciprocally movable to one another. The upper segment and lower segment may be collectable disposable into and out of a compressed position and an uncompressed position. The biasing structure may at least partially assume the energy of an impact associated with a recoil cycle when it is compressed and when the upper segment and lower segment are collectively disposed in the compressed position.

20 Claims, 6 Drawing Sheets

(56) References Cited

U.S. PATENT DOCUMENTS

| | | | | |
|---|---|---|---|---|
| 2013/0192114 | A1* | 8/2013 | Christenson | F41A 3/84 42/16 |
| 2014/0059909 | A1* | 3/2014 | Caudle | F41A 3/84 42/1.06 |
| 2014/0224112 | A1* | 8/2014 | Verry | F41A 3/80 89/130 |
| 2015/0192380 | A1* | 7/2015 | Hilsabeck | F41C 23/06 42/1.06 |
| 2017/0067716 | A1* | 3/2017 | Huang | F41C 23/06 |
| 2017/0205164 | A1* | 7/2017 | Cassels | F41A 3/84 |
| 2017/0314886 | A1* | 11/2017 | Huang | F41A 25/12 |
| 2018/0328682 | A1* | 11/2018 | Myers | F41A 3/84 |
| 2020/0232733 | A1* | 7/2020 | Newberry | F41A 3/82 |
| 2021/0239415 | A1* | 8/2021 | Bray | F41A 3/82 |

* cited by examiner

BUFFER BUMPER ASSEMBLY FOR USE WITH A WEAPON RECOIL SPRING

CROSS-REFERENCE TO RELATED APPLICATION

This application claims the benefit of U.S. Provisional Patent Application Ser. No. 62/961,969 filed on Jan. 16, 2020, the contents of which are herein incorporated by reference in their entirety.

BACKGROUND OF THE INVENTION

Field of the Invention

The present invention is directed to a buffer assembly for use with rifles and other related weapons.

Description of the Related Art

Various firearms, including long guns such as rifles, and shot guns incorporate a butt stock. Of these firearms that incorporate a butt stock, some may incorporate a recoil based operating system. Examples of firearms with a recoil based structure system include semi-automatic and selective rifles as well as shotguns. Such recoil based systems generally incorporate a reciprocating mass that that recoils away from the weapon's firing assembly. A recoil cycle may be triggered by some mechanism, which may be gas operated or inertia operated. This generally results in a reciprocal recoiling force. That is, the reciprocating mass may move towards the rear of the weapon against the tension of a recoil spring. The recoil spring will then move the reciprocating mass forward back to its initial position to complete an action cycle of the weapon. The force associated with movement of the reciprocating mass towards its initial position is intended to extract a spent round from the firing chamber of the weapon. More specifically, the reciprocating mass may move towards the rear of the weapon as the recoil spring compresses. When the reciprocating mass reaches the end of the recoil stroke towards the rear of a weapon, the reciprocating mass moves forward under the pressure of the compressed recoil spring. During this process, the spent round of ammunition is not only extracted from the chamber, but also the firing chamber is reloaded with a fresh round of ammunition, which may come, for example, from a magazine.

More specifically, a buffer may be incorporated to at least partially lower the impact or force exerted against the body of the shooter. Such firearms incorporating a buffer may include various configurations, may comprise various weights and/or may be configured to operate with various caliber size bullets. Thus, based on the individual characteristics of a specific firearm, a buffer(s), of varying weight, may be incorporated, including to add mass to the reciprocating assembly under recoil.

The reciprocating mass generally may comprise the combined mass associated with the bolt, bolt carrier, and buffer, all of which may be disposed inside of a buffer tube. Accordingly, the reciprocating mass may recoil inside of the buffer tube when it is subjected to pressure, for example, from direct gas impingement or from indirect gas impingement, for example, via a piston, or by inertia alone. The buffer tube may extend out of the back of the receiver and may be disposed inside the butt stock of the weapon.

Under full spring compression, a portion of the buffer bumper assembly may come into contact with the interior rear surface of the buffer tube. Thus, when a round of full powered ammunition is fired, a direct impact generally causes the reciprocating mass to come to an abrupt halt prior to traveling in the opposite direction as the now compressed recoil spring decompresses. This abrupt impact caused by the reciprocating mass generally results in at least some energy being absorbed by the weapon.

In some weapons, it is possible to adjust the pulse of the recoil spring, by adding or removing weight from the buffer, thereby adjusting the overall reciprocating mass. That is, the speed associated with a recoil cycle may be increased or decreased by adding or subtracting weight from the buffer. A recoil buffer may be disposed between the rear of the bolt carrier assembly and the recoil spring. The recoil pulse may be slowed or increased according to the need. For example, a standard AR-15 carbine buffer may usually weigh about 2.9 ounces to about 3.0 ounces. Heavier buffers may be provided in a standard length, and may weigh up to 6.4 ounces. Other buffers may include rifle and carbine buffers, which may have different lengths and weights.

However, there are drawbacks associated with existing recoil based systems. Primarily, existing buffer systems do not make provision for the stress and energy transfer occurring when the end of the buffer strikes the interior of the buffer tube under full recoil. Some weapon configurations may require lighter or heavier buffers, depending on the caliber of the weapon. Some inertia based systems, (for example weapons firing pistol calibers in a carbine) may also require shortening of the recoil travel distance in order to achieve an effective buffer effect. This may be accomplished by incorporating a longer buffer. Other systems involve an additional expense associated with replacing the entire buffer.

Other alternative systems incorporating gas compression also have drawbacks as they are also expensive. Gas compression systems may also be temperature sensitive. Depending on the specific gas used, such systems are only effective within certain temperature ranges. Such systems incorporating gasses may be susceptible to overheating as the temperature tends to increase as the underlying gas is compressed. Thus, if the temperature exceeds certain values, the recoil absorbing effect may be reduced or essentially nullified if the pressure is too high for compression to take place during recoil. Conversely, if the temperature is too low, the recoil absorbing effect is nullified because the pressure may be too low for an effective compression. Some gasses may be effective within broader temperature ranges, but they are generally expensive. As such, and given the need to operate weapons in various environmental conditions (e.g., the arctic or dessert extremes), the foregoing systems are not generally reliable under most environmental conditions.

As such, there is a need in the weapon industry for a recoil based system with a buffer bumper assembly that overcomes the prior drawbacks and that may provide other advantages. A need exists to provide a buffer bumper assembly where the biasing action could take place within the bumper itself, thereby eliminating the need for a complete replacement of the buffer bumper assembly. Accordingly, A benefit would be realized by providing a buffer bumper assembly with a biasing structure disposed therein. This may at least partially lower the resulting action or otherwise energy that is transferred to the rest of the weapon from the impact associated with firing the weapon. An even further benefit of such removable features would substantially eliminate the need to incorporate various permanent components that would otherwise be needed. Another benefit would be realized if such a buffer bumper assembly could provide substantially adequate levels of compression irrespective of the specific environmental conditions.

SUMMARY

The present invention is directed to a buffer bumper assembly that may be used in connection with some firearms that incorporate a recoil based mechanism. The inventive buffer bumper assembly comprises an upper segment, a lower segment, a biasing structure and a connector. The upper segment and lower segment are interconnected and are disposed in a reciprocally movable relation to one another. The upper segment may comprise a body with an aperture configured for the body of the connector to pass there through and connect the upper segment to a socket of the lower segment. The upper segment may comprise a retaining wall that may cooperatively configured and dimensioned with a sidewall of the lower segment to enable a slidable and reciprocal movement between the upper segment and the lower segment. Slots may be formed on the upper segment and lower segment. The slots may be configured to retain at least a portion of the biasing structure. As such, the biasing structure may be disposed on an inside of the upper segment and lower segment. Collectively, the upper segment and lower segment may be connected to substantially define a bumper. In addition the front surface of the upper segment may be configured and dimensioned to conform to the shape of another surface onto which it may come into contact, e.g., the rear of a buffer tube.

The upper segment and the lower segment may be connected by the connector with the biasing assembly at least partially disposed on the slots of the lower segment and upper segment. For example, the upper segment and lower segment may be collectively configured to retain the biasing assembly between them. For example, at least a portion or end of the biasing assembly may be disposed the slot upper segment, whereas a different portion or opposite end of the biasing assembly may be disposed the slot of the lower segment. The lower segment and upper segment may also be connected to each other with the connector, which may pass through an opening of the biasing assembly. It is within the scope of the present invention that the upper segment should reciprocally move along its length and with respect to the connector and the lower segment. As such, the connector may remain fixed or otherwise non-movable with respect to the lower segment once it is connected. As an example, the upper segment may comprise a first shoulder configured to stop further movement of the connector on an inside of aperture, i.e., by defining an area of the upper segment which will come into contact with a bottom portion of the head of the connector, and which will stop further movement of the connector, and consequently the lower segment, beyond an intended distance. Thus, the upper segment and lower segment may reciprocally move with respect to one another.

A reciprocal movement of the upper segment and lower segment allows the inventive buffer bumper assembly to be disposed into and out of a compressed position and uncompressed position. In the uncompressed or natural position, i.e., during non-use of the weapon, the upper segment and lower segment should have at least a separation between them and the biasing structure should be uncompressed. In the compressed position, i.e., during the impact associated with a recoil cycle, the biasing structure should be temporarily compressed thereby absorbing the energy associated with the impact. After impact, the biasing assembly, as well as the biasing structure, should return to the uncompressed or natural positon.

DETAILED DESCRIPTION

Figure 1:
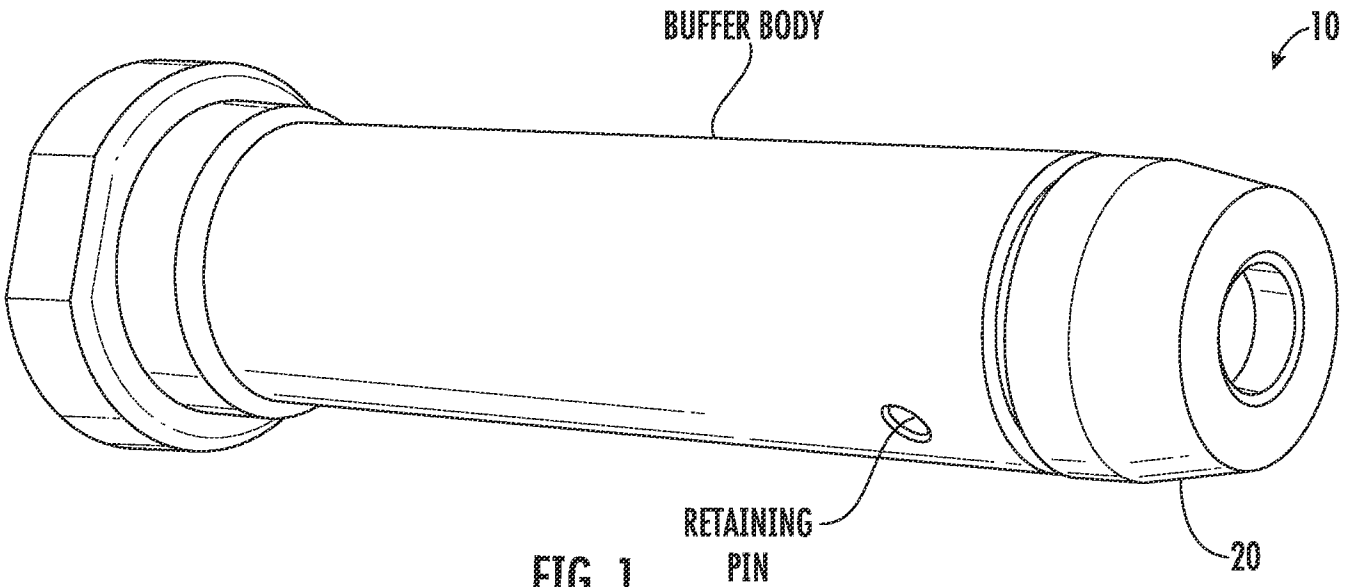
FIG. 1 is a side perspective view of one illustrative embodiment of the buffer bumper assembly according to the present invention connected to a buffer body.
Figure 2:
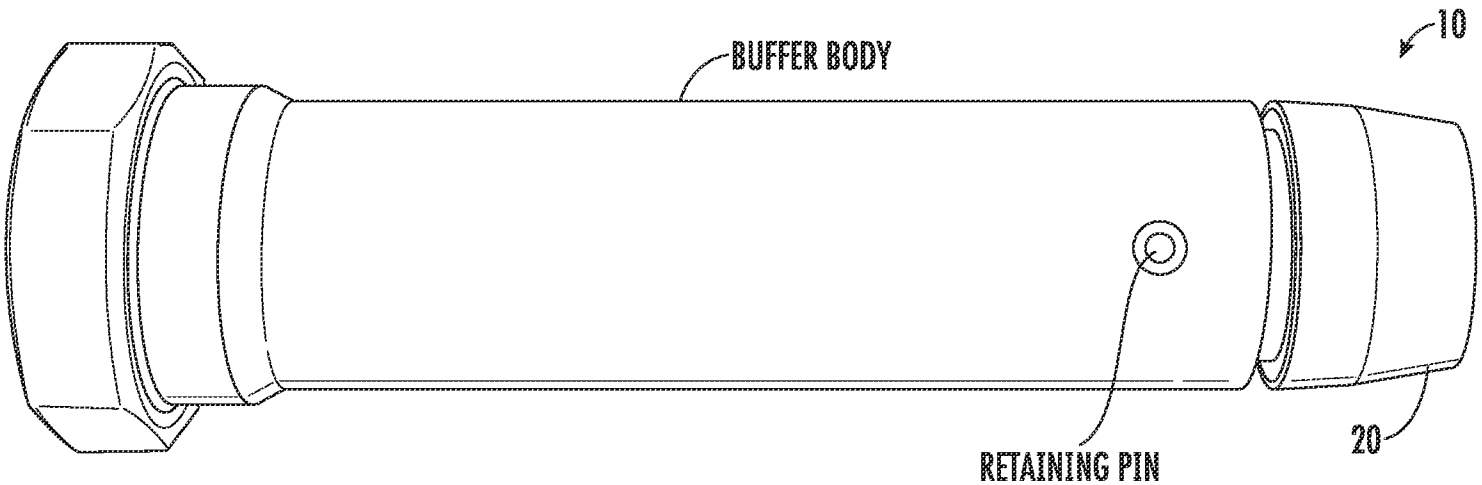
FIG. 2 is a side view of another illustrative embodiment of the buffer bumper assembly according to the present invention connected to a buffer body.

With initial reference to FIGS. 1-6, the present invention is directed to a buffer bumper assembly 10 that may be used in connection with firearms that incorporate a recoil spring mechanism. As seen in FIGS. 1-2, the inventive buffer bumper assembly 10 may be disposed or otherwise attached to a buffer body, for example via a retaining pin or a crossing pin. The buffer body with the inventive bumper assembly, i.e., FIG. 1, may be disposed on a recoil spring of a firearm, which itself may be disposed on an inside of a buffer tube around an end thereof. Such firearms may be manufactured in different dimensions and may be configured to operate with different caliber size ammunition. Such ammunition may include, but is not limited to smaller frame weapon chambering, by way of example, 5.56 NATO 223 Remington, 6.5 Grendel, 6.8 SPC, 300 Blackout, and larger frame weapons chambered in, by way of example, 7.62 NATO, 243 Winchester, and 308 Winchester. Non-limiting examples of such firearms include Armalite® rifles, including those designed by Eugene Stoner, such as AR-10®, AR-15®, M16, SR-25, and LR-308. For example, some systems, including rifles manufactured by Armalite®, may incorporate a variable weight buffer bumper structure to the reciprocating mass. Such a variable weight buffer bumper structure may be enclosed within the recoil spring. In addition, a biasing structure 40 of the buffer bumper assembly 10, which will be explained later, may be used in connection with smaller frame weapons designed to fire pistol calibers and that require a reduced length recoil stroke.

Figure 3:
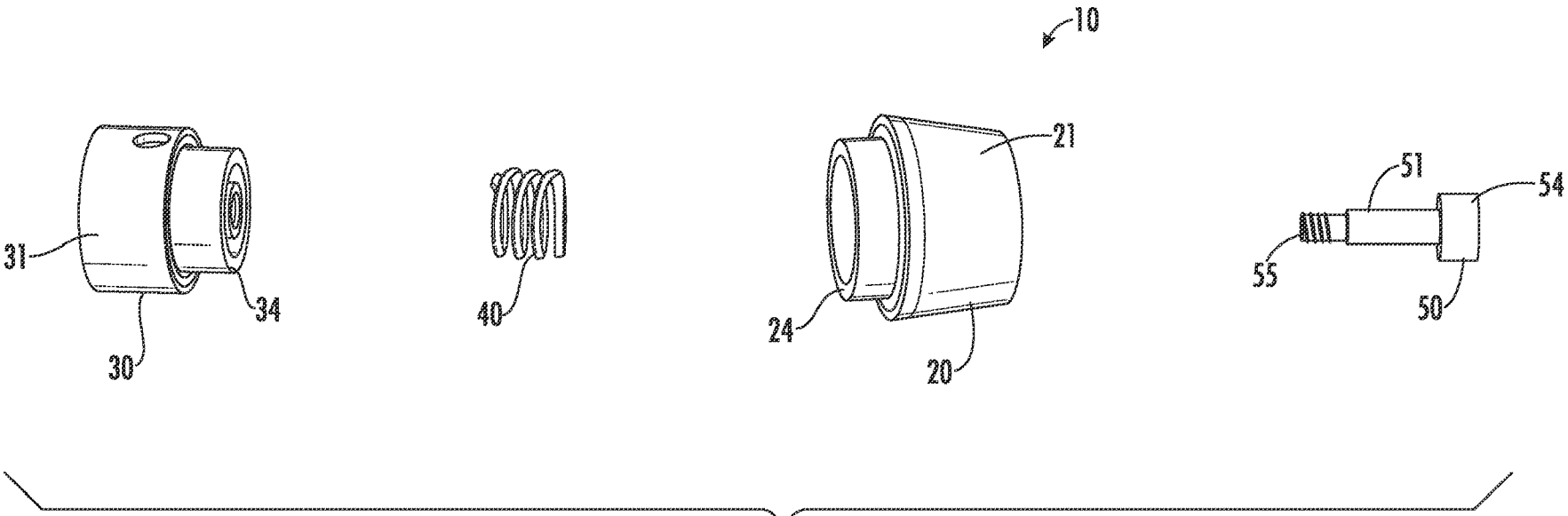
FIG. 3 is an exploded view of one illustrative embodiment of the buffer bumper assembly according to the present invention.
Figure 4:
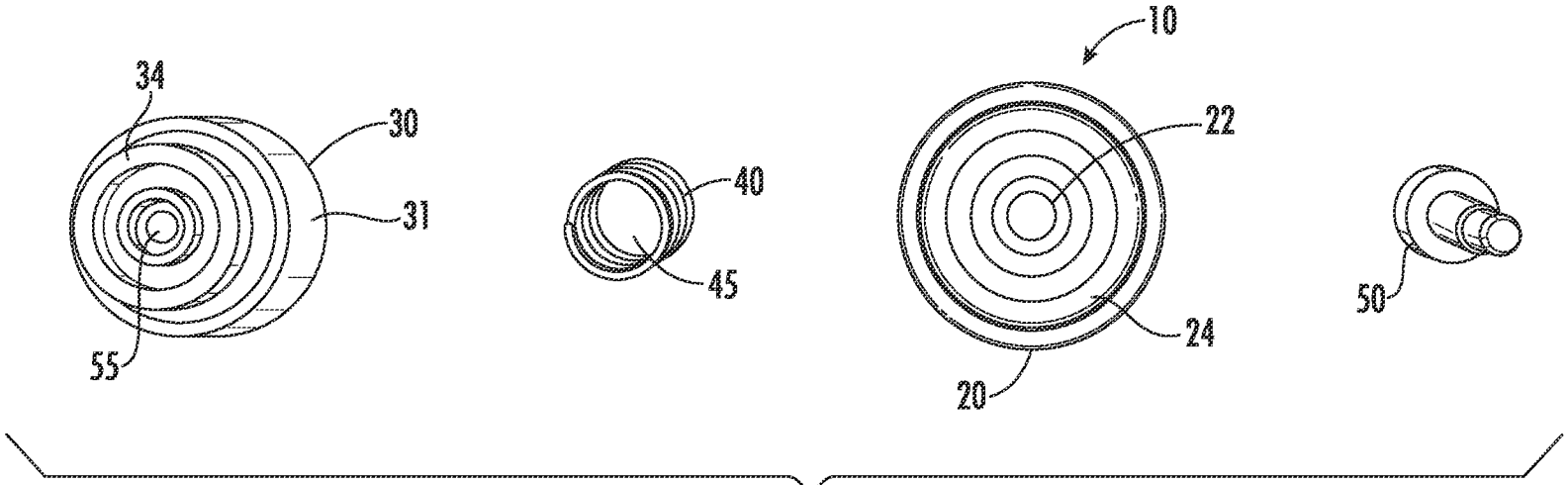
FIG. 4 is a top exploded view of yet another illustrative embodiment of the buffer bumper assembly according to the present invention.

With reference to at least FIGS. 3-4, the inventive buffer bumper assembly 10 comprises an upper segment 20, a lower segment 30, a biasing structure 40 and a connector 50. The various components of the buffer bumper assembly 10 may be provided in various dimensions and configurations to correspond to the specific size of the intended weapon. It is within the scope of the present invention that together with the recoil spring, the inventive buffer bumper assembly 10, act as a dual compression mechanism that at least partially reduces the force or shock effect associated with firing a weapon incorporating a recoil spring mechanism. Accordingly, the buffer bumper assembly 10, when disposed on a recoil spring and on an inside of a buffer tube, is intended to absorb at least some of the energy associated with a recoil cycle. Ordinarily, such energy may otherwise be transferred to the rest of the weapon. Instead of a buffer bumper coming into abrupt contact with the rear or opposite section of a buffer tube, the inventive buffer bumper assembly 10, may at least partially absorb some of the energy that remains from the action a recoil cycle before the direction of the reciprocating stroke reverses. This reduction or absorption of energy, which may be enabled by the biasing structure 40, may at least partially reduce component stress and may at least partially increase the consistency of the forward portion of the recoil stroke. Further, this reduction or absorption of energy may at least partially lower, and sometimes eliminate, the perceived impact during a recoil cycle, which may at least partially increase the durability of a weapon.

Figure 5:
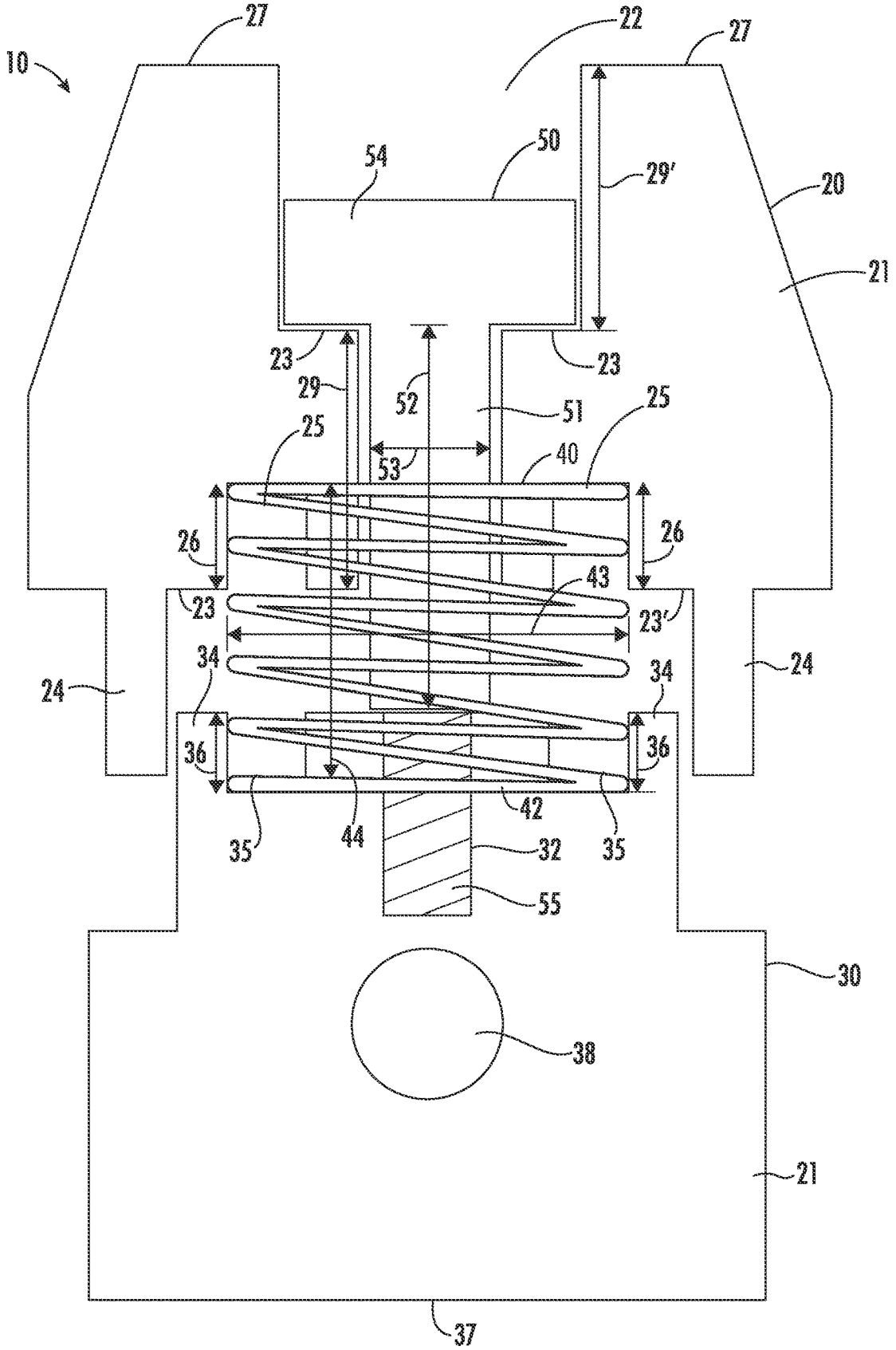
FIG. 5 is section view of one illustrative embodiment of the buffer bumper assembly according to the present invention disposed in the uncompressed position.
Figure 6:
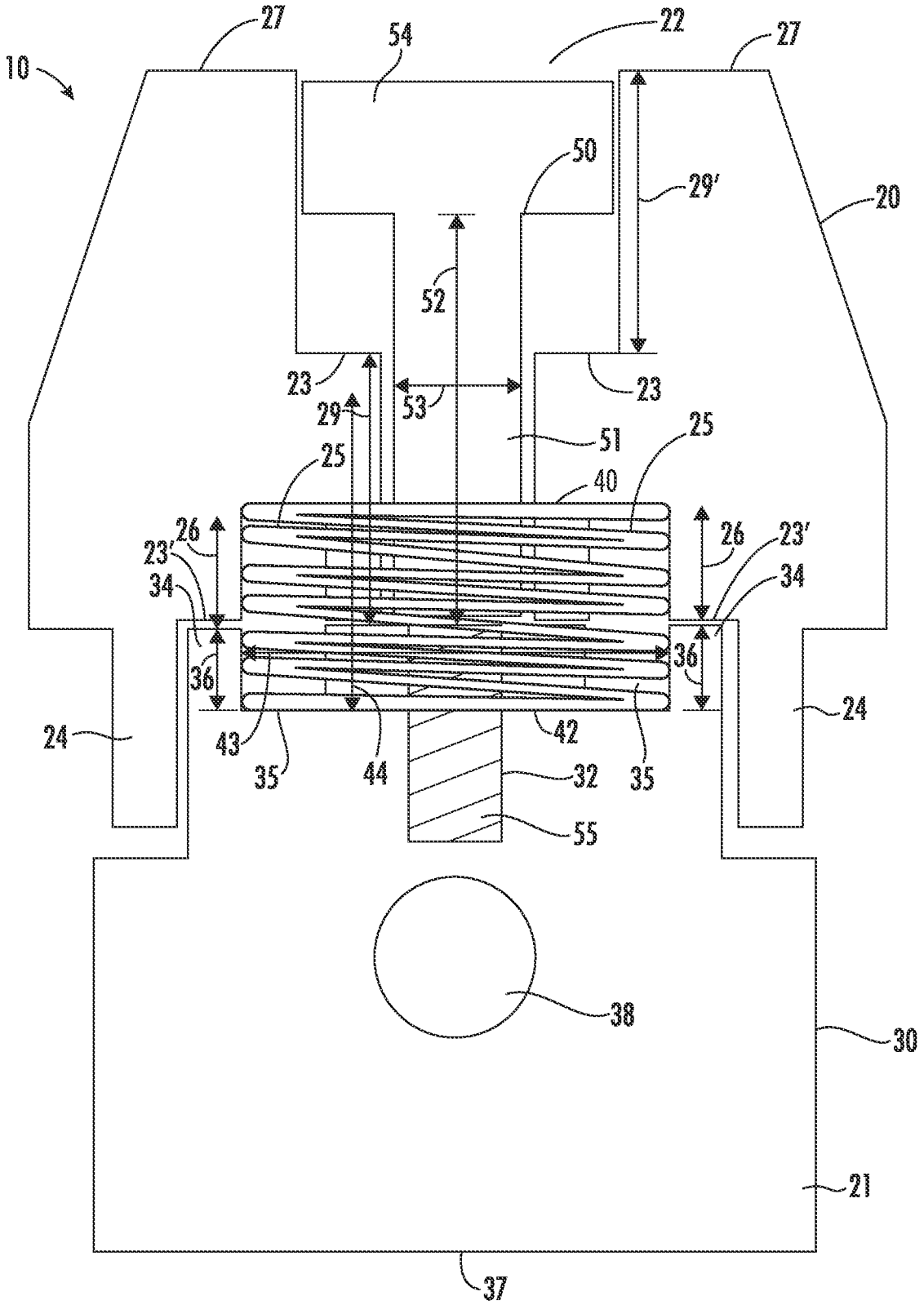
FIG. 6 is section view of another illustrative embodiment of the buffer bumper assembly according to the present invention disposed in the compressed position.

With reference to at least FIGS. 5-6, features of the present invention include various components which enable a reciprocal movable relation between the upper segment 20 and the lower segment 30. The upper segment comprises a body 21 with an aperture 22 extending between both ends thereof. The aperture 22 is primarily intended to house or otherwise receive the connector 50. As shown at least in FIGS. 5-6, the aperture may be provided between a front surface 27 and may extend to an opposite surface of the upper segment 20. By way of example only, the body 21 of the upper segment 20 may comprise a substantially cylindrical lower section and a substantially semi-conical upper section. A first shoulder 23 of the upper segment 20 may be configured and dimensioned to retain a head 54 of the connector 50. Furthermore, the aperture 20 may comprise different diameters. For example, the aperture 22 may comprise a larger diameter around the length 29' of an upper portion of the aperture 22, which is the area where the head 54 of the connector 50 may pass through. Further, the aperture 22 may comprise a lesser diameter around the area of the body 51 of the connector 51. For example, the diameter of the aperture 22 around this area may be configured to accommodate an inner diameter 53 of the connector 50. It is within the scope of the present invention that the length 52 of the body 51 of the connector 50 be at least partially greater than the length 29 of the aperture 22 at its section having a reduced diameter.

As is also shown in at least FIGS. 5-6, the lower segment 30 comprises a body 31 with a rear surface 37 and a sidewall 34. As an example, the body 31 of the lower segment 30 may comprise a substantially cylindrical shape. The sidewall 34 is primarily intended to at least partially enable a reciprocal and movable relation between the upper segment 20 and the lower segment 30. That is, the sidewall 34 and/or the retaining wall 24 may be cooperatively configured and dimension to enable such a reciprocal and movable relation between the upper segment 20 and the lower segment 30. For example, as shown in FIGS. 5-6, the retaining wall 24 and sidewall 34 may comprise a substantially circular configuration. Furthermore, the retaining wall 24 may have a greater diameter than the diameter of the sidewall 34. As such, the sidewall 34 may be disposed in confronting relation to a second shoulder 23' of the upper segment 20. In the configuration as shown in FIGS. 5-6, because the retaining wall 24 has a larger diameter than the sidewall 34, the retaining wall 24 serves as an enclosure to the sidewall 34. Therefore, sideways movement between the upper segment 20 and the lower segment 30 may be at least partially reduced, and in some embodiments substantially reduced. In turn, the configuration of the retaining wall 24 and sidewall 34 may at least partially enable a reciprocal movement between the upper segment 20 and the lower segment 30. That is, the upper segment 20 and/or lower segment 30 may reciprocally move with respect to one another about an axis substantially defined by the length 52 of the body 51 of the connector 50 or otherwise the length 44 and/or 44' of the biasing structure. As mentioned above, the buffer bumper assembly 10 may be connected to a buffer body via a retaining pin. For example, and as is shown in FIGS. 1-2 and 5-6, a retaining pin may be inserted into an opening(s) of the buffer body and the same pin may pass through an opening 38 of the lower segment 30.

As shown in FIGS. 5-6, the upper segment 20 may be provided with a first slot 25, whereas the lower segment 30 may be provided with a second slot 35. The slots 25 and/or 35 may comprise a depth 26 and/or 36 and are primarily intended to retain at least a portion of the biasing structure 40. As shown in the illustrative embodiment of FIG. 6, which shows the upper segment 20 and the lower segment 30 disposed in the compressed position, the depth 26 of the first slot 25 and the depth 36 of the second slot 35 may be substantially equivalent to the compressed length 44' of the biasing structure 40. In some embodiments the sum of depths 26 and 36 may be at less than the length of the compressed length 44' and/or the uncompressed length 44 of the biasing structure 40. The slots 25 and/or 35 should be configured and dimensioned so that movement of the biasing structure in a sideways direction is at least partially restricted. Thus the sidewall 34 and/or other portions of the upper segment 20 and/or lower segment 30 may be configured and dimensioned to define the slots 25 and/or 35 according to the specific geometry and dimensions of the biasing structure 40.

With reference now to at least FIGS. 3-6, and as mentioned above, the buffer bumper assembly 10 according to the present invention comprises a biasing structure 40. The biasing structure 40 is intended to be disposed on an inside of the upper segment 20 and/or lower segment 30, e.g., on slots 25 and/or 35. Further, the biasing structure 40 is intended to act as a shock absorber, for example when the front surface 27 of the upper segment 20 comes into contact with another surface such as the rear portion of a buffer tube during a recoil cycle after the weapon is fired. Further, the biasing structure 40 may comprise, without limitation, a spring, and may also comprise various shapes that may facilitate connecting or otherwise disposing the biasing structure 40 on the upper segment 20 and/or lower segment 30. As a non-limiting example, and as shown at least in FIGS. 3-4, the biasing structure 40 may comprise a substantially cylindrical shape that may enable the slots 25 and/or 35 to retain it. A substantially cylindrical shape is not strictly necessary, however, as the biasing structure 40 may comprise other shapes. The biasing structure 40 may also comprise an opening 45, through which a connector 50 may pass.

With reference to at least FIGS. 3-6, and as mentioned above, the buffer bumper assembly 10 according to the present invention comprises a connector 50, which is intended to interconnect the upper segment 20 and the lower segment 30. The connector 50 is also intended to at least partially enable a reciprocal movement between upper segment 20 and the lower segment 30. Accordingly, the connector 50 may comprise a body 51, a head 54 and/or a connecting structure 55. By way of example only, the connector 50 may comprise a shoulder screw, but may also comprise other types of connectors, including other types of screws, bolts, retainers, etc. Thus, the body 51 of the connector 50 is intended to pass through a lower section of the aperture 22, and may comprise a length 52 that is at least the same length as the length 29 of the aperture around this section with a reduced diameter. Additionally, the length 52 of the body 51 may be at least the same length as the compressed length 44' of the biasing structure 40. The length 52 of the body 51 may also be at least the same length as the uncompressed length 44 of the biasing structure 49. Further, and as mentioned above, the connector 50 may pass through the opening 45 of the biasing structure 40. It is within the scope of the present invention that the body 51 of the connector 50 comprise a surface that permits a movement of the connector 50 on an inside of the aperture 22 of the upper segment 20. Thus, at least a portion of the surface of the body 51 of the connector 50 should be substantially even. As is perhaps best shown in FIGS. 5-6, the connector 50 may comprise a connecting structure 55, which may have, for example, a threaded configuration or another related configuration that enables a mating engagement or otherwise a connection between the connector 50, and consequently the upper segment, and socket 32 of the lower segment 30. For example, both the connecting structure 55 and the socket 32 may be dimensioned and may be provided with corresponding threaded configurations such that a mating engagement may be formed or otherwise enabled between them. In addition, various configurations of the head 54 of the connector 50, which is accessible from the aperture 22 of the upper segment 20, may be provided to rotate or otherwise drive the connector 50 into the socket 32. In turn the hear may be provided with a configuration suitable for adjustment via a variety of tools, e.g., Philips head or flat head screws, Allen wrenches, etc. As a result, movement of the connector 50 should be substantially limited once it is connected to the lower segment 30, e.g., to the socket 32.

With specific reference to FIGS. 5-6, and as mentioned above, features of the present invention comprise the buffer assembly 10 being disposable into and out of a compressed position and an uncompressed position. More specifically, the upper segment 20 and the lower segment 30 may be collectively disposed into an uncompressed position, for example, as is shown in FIG. 5, and a compressed position, for example, as is shown in FIG. 6. It is within the scope of the present invention that the buffer bumper assembly 10 be disposed into, or should otherwise assume, the compressed position upon an impact of the upper segment 20, e.g., on its front surface 27, with another surface, e.g., the rear portion of a buffer tube. Said differently, the buffer bumper assembly 10 may reach substantially full compression and assume the compressed position, when the upper segment 20 strikes the rear of the buffer tube. This may occur, for example, after firing a weapon during a recoil cycle.

As shown in FIG. 6, in the compressed position, the biasing assembly 40 should be compressed. That is, the biasing assembly 40 should achieve a compressed length 44' substantially during impact. As a result, the biasing assembly 40 may at least partially absorbed the energy of the impact during its compression. Substantially before or substantially after impact, the buffer bumper assembly 10 should be disposed into, or should otherwise assume, the uncompressed positon, e.g., as shown in FIG. 5. Movement of the buffer bumper assembly 10 into and out of the compressed and uncompressed positions, e.g., during a recoil cycle, may at least partially contribute to increasing the effective life of the underlying weapon by at least partially reducing the force associated with impact of the buffer bumper assembly 10 with the buffer tube. In addition, such compression feature of the inventive buffer bumper assembly 10 should at least partially reduce a "buffer bump" effect, which may be a drawback of some weapons.

With specific reference to FIG. 5, is also within the scope of the present invention that during periods of non-use and/or non-operation of the underlying weapon, that the buffer bumper assembly 10 remain in the uncompressed position or otherwise its natural position as the inherent force of the biasing structure 40 should allow for the buffer bumper assembly 10 to assume the uncompressed position. In addition the connector 50, should be configured to allow a reciprocal movement of the upper segment 20 and the lower segment 30. For example, the connector 50 should be disposed in non-obstructing relation to the movement of the upper segment 20, lower segment 30, and/or biasing structure 40.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A buffer bumper assembly for use in connection with a weapon, said buffer bumper assembly disposable on a recoil spring and on an inside of a weapon buffer tube, said buffer bumper assembly comprising:

an upper segment comprising a body having a front surface and a retaining wall, a lower segment comprising a rear surface and a sidewall, a biasing structure at least partially disposed on an inside of said upper segment and on an inside said lower segment, a connector disposed on an inside of said upper segment and on an inside of said lower segment, said connector configured to connect the upper segment and the lower segment, and said biasing structure, said upper segment and said lower segment cooperatively configured to at least partially absorb an energy associated with an impact of said upper segment with the rear of the buffer tube.

2. The buffer bumper assembly as recited in claim 1 wherein said upper segment comprises an aperture disposed substantially around a center of said body of said upper segment.

3. The buffer bumper assembly as recited in claim 2 wherein said upper segment comprises a first shoulder configured to retain a head of said connector.

4. The buffer assembly as recited in claim 2 wherein said upper segment comprises an inner diameter that is at least greater than a diameter of a body of said connector.

5. The buffer bumper assembly as recited in claim 1 wherein said upper segment comprises a first slot configured to retain at least a portion of said biasing structure.

6. The buffer bumper assembly as recited in claim 1 wherein said lower segment comprises a second slot configured to retain at least a portion of said biasing structure.

7. The buffer bumper assembly as recited in claim 1 wherein said retaining wall and said sidewall are cooperatively configured to define a slidable relation between said upper segment and said lower segment.

8. The buffer bumper assembly as recited in claim 1 wherein said retaining wall and sidewall are cooperatively configured to define a reciprocal movable relation between said upper segment and said lower segment.

9. The buffer assembly as recited in claim 1 wherein said upper segment and said lower segment are collectively disposable into a compressed position and au uncompressed position.

10. The buffer bumper assembly as recited in claim 1 wherein said lower segment comprises an opening configured to receive a cross pin.

11. A buffer bumper assembly for use in connection with a weapon, said buffer bumper assembly disposable on a recoil spring and on an inside of a weapon buffer tube, said buffer bumper assembly comprising:

an upper segment comprising a body with a front surface, a retaining wall, an aperture disposed substantially around a center of said body and a first slot defined on said body and comprising a depth, a lower segment comprising a rear surface, a sidewall, a socket and a second slot adjacently disposed to said sidewall and comprising a depth, a biasing structure disposed on an inside of said upper segment and on an inside said lower segment, a connector comprising a body, said connector disposed on an inside of said upper segment and on an inside of said lower segment, said connector configured to connect the upper segment and the lower segment, and said biasing structure, said upper segment and said lower segment cooperatively configured to at least partially absorb an energy associated with an impact of said upper segment with the rear of the buffer tube.

12. The buffer bumper assembly as recited in claim 11 wherein said depth of said first slot and said depth of said second slot are substantially equivalent to a compressed length of the biasing structure.

13. The buffer bumper assembly as recited in claim 11 wherein said connector comprises a connecting structure configured to form mating engagement with said socket.

14. The buffer bumper assembly as recited in claim 13 wherein each of said connecting structure and said socket comprise a threaded configuration configured to form said mating engagement between said connecting structure and said socket.

15. The buffer bumper assembly as recited in claim 11 wherein a length of said body of said connector is greater than an uncompressed length of said biasing structure.

16. The buffer bumper assembly as recited in claim 11 wherein a diameter said biasing structure is greater than a diameter of said body of said connector.

17. The buffer bumper assembly as recited in claim 11 wherein said body of said connector is configured to pass through an opening of said biasing structure.

18. The buffer bumper assembly as recited in claim 11 wherein said diameter of said spring is greater than a diameter of said aperture.

19. The buffer bumper assembly as recited in claim 11 wherein said sidewall is disposed in confronting relation with a second shoulder of said upper segment when said upper segment and said lower segment are disposed in said compressed position.

20. A buffer bumper assembly for use in connection with a weapon, said buffer bumper assembly disposable on a recoil spring and on an inside of a weapon buffer tube, said buffer bumper assembly comprising:

an upper segment comprising a body with a front surface, a retaining wall, an aperture disposed substantially around a center thereof and a first slot defined on said body and comprising a depth, a lower segment comprising a rear surface, a sidewall, a socket and a second slot adjacently disposed around said sidewall and comprising a depth, a biasing structure at least partially disposed on an inside of said upper segment and on an inside said lower segment, a connector comprising a body, said connector disposed on an inside of said upper segment and on an inside of said lower segment, said connector configured to connect the upper segment and the lower segment, said biasing structure, said upper segment and said lower segment cooperatively configured to at least partially absorb an energy associated with an impact of said upper segment with the rear of the buffer tube, said connector comprises a connecting structure configured to form mating engagement with said socket, said body of said connector is configured to pass through an opening of said biasing structure, and said sidewall is disposed in confronting relation with a second shoulder of said upper segment when said upper segment and said lower segment are disposed in said compressed position.

* * * * *